United States Patent [19]

Michel

[11] 4,075,979

[45] Feb. 28, 1978

[54] ASSEMBLY OF A COMBUSTION CHAMBER NOSE IN A CONTINUOUS-FLOW BOILER HAVING A TWO-SECTION CONSTRUCTION WITH GAS-TIGHTLY WELDED WALLS

[75] Inventor: Rupprecht Michel, Erlangen, Germany

[73] Assignee: Kraftwerk Union Aktiengesellschaft, Mulheim (Ruhr), Germany

[21] Appl. No.: 750,163

[22] Filed: Dec. 13, 1976

[30] Foreign Application Priority Data

Dec. 19, 1975 Germany ..... 2557427

[51] Int. Cl.[2] ..... F22B 27/04; F22B 29/06

[52] U.S. Cl. ..... 122/235 A; 122/235 K; 122/406 S

[58] Field of Search ..... 122/6 A, 235 R, 235 A, 122/235 C, 235 K, 406 S, 510

[56] References Cited

U.S. PATENT DOCUMENTS

| | | | |
|---|---|---|---|
| 3,289,645 | 12/1966 | Evans | 122/510 |
| 3,298,360 | 1/1967 | Michel | 122/510 |
| 3,359,948 | 12/1967 | Knizig | 122/235 |
| 3,396,707 | 8/1968 | Bagley et al. | 122/510 |
| 3,400,689 | 9/1968 | Bagley et al. | 122/510 |

*Primary Examiner*—Kenneth W. Sprague
*Attorney, Agent, or Firm*—Herbert L. Lerner

[57] ABSTRACT

A continuous-flow boiler has a two-section construction with gas-tightly welded walls and having a structure forming a combustion-chamber nose disposed beneath a horizontal section connecting both sections of the two-section boiler and including combustion chamber walls formed of a helical winding made up of wound parallel tubes which terminate in transition headers located externally to the combustion chamber walls at a point of transition of the tubes into vertical-tube walls extending upwardly from the helical winding, the combustion-chamber nose having a forward edge and an upper nose incline extending for a given distance along the top of the helical winding toward a front wall of the combustion chamber walls, two of the transition headers being disposed respectively adjacent lateral walls of the combustion chamber and extending from the front wall and terminating at the forward edge of the combustion-chamber nose, the tubes of the helical winding, in the region of the nose, being bent upwardly unwelded, auxiliary headers being disposed in step-wise offset relationship to one another below the nose incline, and the upwardly bent tubes of the helical winding being connected to the auxiliary headers, the lateral walls of the combustion chamber above the nose incline being formed of tubes extending upwardly from the auxiliary headers.

3 Claims, 1 Drawing Figure

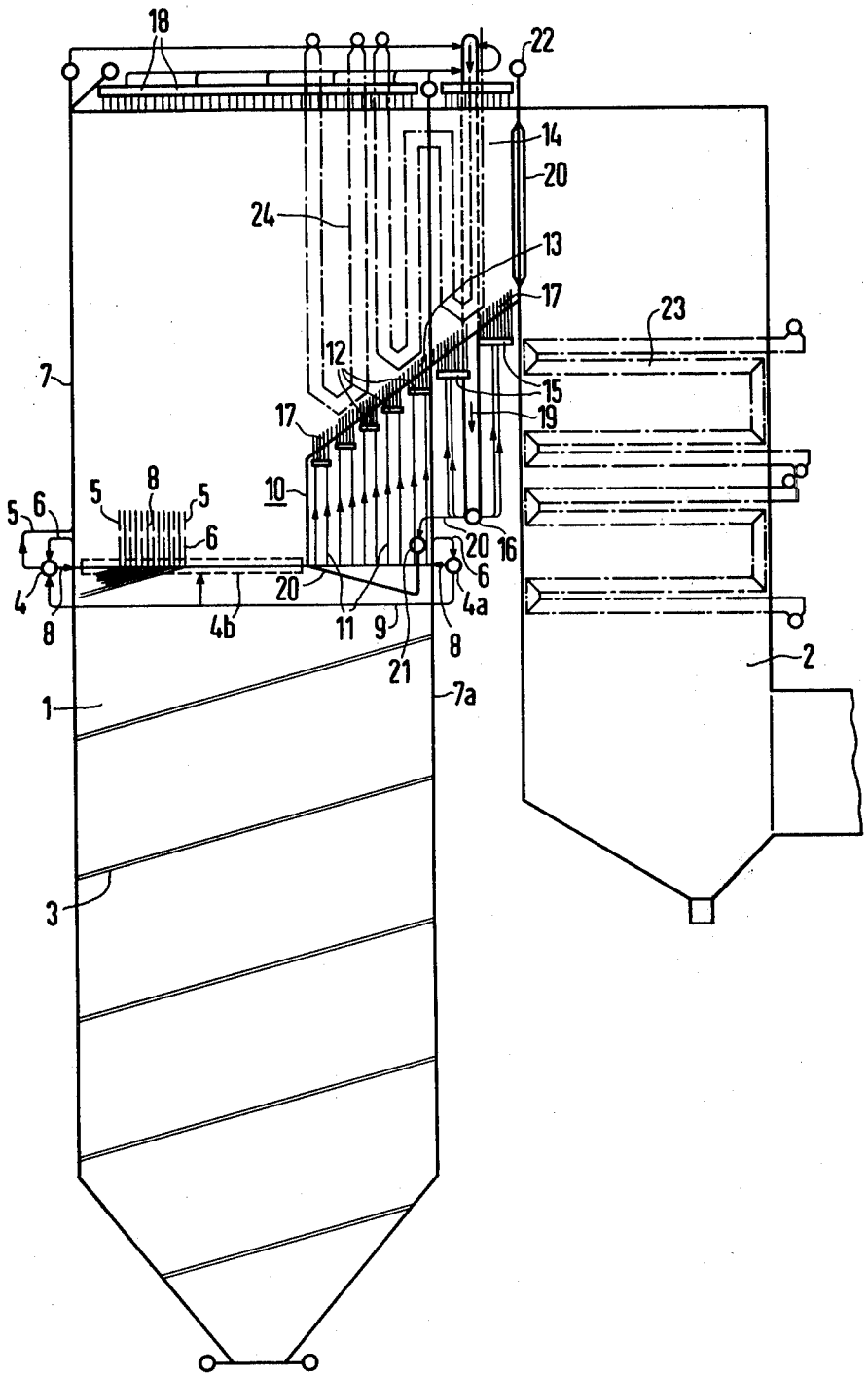
18
22
14
20
24
13
17
23
12
15
7
19
17
10
5
8
5
5
6
6
20
16
4
20
6
8
4b
11
9
4a
8
21
2
7a
1
3

ASSEMBLY OF A COMBUSTION CHAMBER NOSE IN A CONTINUOUS-FLOW BOILER HAVING A TWO-SECTION CONSTRUCTION WITH GAS-TIGHTLY WELDED WALLS

The invention relates to a continuous-flow boiler having a two-section construction with gas-tightly welded walls and, more specifically, to the assembly of a combustion chamber nose therein.

Combustion chambers of such continuous-flow boilers are formed at a lower part thereof of a helical winding. In the upper part of such a combustion chamber, the tube system of the helical winding transforms into a vertical tube system of a multiplicity of parallel tube lengths through the intermediate connection of externally disposed transition headers.

It is an object of the invention to provide an especially simplified structure for a combustion chamber nose which reduces the flow cross section of the flue gas at the rear wall of the first section of the boiler above the helical winding and which forms a floor extending at an upward inclination from the first to the second section of the boiler for a horizontal section provided between the first and second sections.

With the foregoing and other objects in view, there is provided, in accordance with the invention, a continuous-flow boiler having a two-section construction with gas-tightly welded walls and having a structure forming a combustion-chamber nose disposed beneath a horizontal section connecting both sections of the two-section boiler and including combustion chamber walls formed of a helical winding made up of wound parallel tubes which terminate in transition headers located externally to the combustion chamber walls at a point of transition of the tubes into vertical-tube walls extending upwardly from the helical winding, the cumbustion-chamber nose having a forward edge and an upper nose incline extending for a given distance along the top of the helical winding toward a front wall of the combustion chamber walls, two of the transition headers being disposed respectively adjacent lateral walls of the combustion chamber and extending from the front wall and terminating at the forward edge of the combustion-chamber nose, the tubes of the helical winding, in the region of the nose, being bent upwardly unwelded, auxiliary headers being disposed in step-wise offset relationship to one another below the nose incline, and the upwardly bent tubes of the helical winding being connected to said auxiliary headers, the lateral walls of the combustion chamber above the nose incline being formed of tubes extending upwardly from the auxiliary headers.

In accordance with another feature of the invention, the combustion chamber has a rear wall and one of the transition headers is disposed adjacent to the rear wall, and including mutually spaced-apart outlet tubes extending from said transition header adjacent the rear wall and through the horizontal section and serving as support elements for the rear wall, at least one further header disposed externally to and above the combustion chamber and being connected to the outlet tubes, and horizontally disposed connecting tubes connecting the transition header adjacent the rear wall to one of the transition headers that is located adjacent the front wall and to the transition headers adjacent the lateral walls of the combustion chamber.

In accordance with a further feature of the invention, the structure includes a horizontal header and intermediate section headers located between the two sections of the boiler, the intermediate section headers being located outside the combustion chamber and having tubes extending therefrom forming at least part of the lateral walls of the horizontal section, downcomers connecting the at least one further header above the combustion chamber to the horizontal header, and outlet tubes extending from the horizontal header and forming in part the tubes of the combustion chamber nose and in part extending and connected to the intermediate section headers.

Other features which are considered as characteristic for the invention are set forth in the appended claims.

Although the invention is illustrated and described herein as embodied in assembly of a combustion chamber nose in a continuous-flow boiler having a two-section construction with gas-tightly welded walls, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a schematic and diagrammatic view of a combustion chamber nose in a continuous-flow boiler having gas-tightly welded walls and being of two-section construction, in accordance with the invention.

Referring now to the FIGURE of the drawing, there are shown therein two sections 1 and 2 of a two-section boiler. The walls of the lower part of the boiler section 1, as shown in the figure, are made up of tubes connected in parallel with one another and forming a helical winding 3. The tubes of the helical winding 3 terminate in four transition headers 4, **4*a* and 4*b* from which vertically running tubes 5 extend and form the walls of the upper part of the boiler section 1**, as viewed in the figure of the drawing.

The point of transition from the helical winding 3 to the walls formed by the vertical tubes 5 is shown as an example at the left hand side of the figure in the boiler section 1. The tubes 6 of the helical winding 3 terminating thereat are bent vertically upwardly at the level of the transition header 4, then project out of the wall of the steam generator and connect from above with the transition header 4. The tubes 5 and 8 which form the walls of the vertical-tube upper part of the boiler section 1, as viewed in the figure, extend out of the transition header 4, the tubes 5 connecting into the forward wall 7 of the boiler section 1 directly above the location at which the tubes 6 extend out of the forward wall. The tubes 6 also connect from above with the transition header **4*a* corresponding to the transition header 4 and located behind the rear wall 7*a* of the boiler stage 1. The tubes 8 extend from the transition header 4*a* as support elements for the rear wall 7*a* of the boiler section 1 in low-density i.e. widely spaced, distribution without welding and through a horizontal section 14 of the boiler and the cover of the boiler. Only so many tubes 8 as are necessary for suspending the rear wall 7*a* extend upwardly from the transition header 4*a*. Since the transition header 4*a* receives the same supplied quantity of steam from the helical winding 3 per unit length as does the transition header 4, connecting tubes 9 are provided which connect the header 4 in front of the forward wall 7 of the boiler section 1 and to transition headers 4*b*, which are disposed on both lateral sides of the boiler section 1 also at the level at which the helical winding 3 ends. The headers 4*b* do not, however, extend across the entire length of the lateral walls of the boiler section 1, but rather, end in front of the combustion chamber nose 10**.

Tubes 11 of the helical winding 3 which terminate in the part of the the lateral walls of the boiler section 1 that is not covered by the transition header **4*b* are bent upwardly unwelded at this location and terminate in auxiliary headers 12 that are disposed in a step-shaped arrangement. The auxiliary headers 12 are disposed beneath a sloping nose incline 13 which forms the upper part of the combustion chamber nose 10 and the lower boundary of the horizontal stage 14. Vertical tubes 17 which, together with the vertical tubes 5 and 8, form the walls of the boiler section 1, in the vertical-tube part thereof, and the walls of the horizontal section 14, extend out of the step-wise disposed auxiliary headers 12 and out of additional intermediate-stage headers 15 disposed in a similar manner and fed by a horizontal header 16 located between the boiler sections 1 and 2. These tubes 5, 8 and 17 are connected to one another like the tubes of the helical winding 3** so that a gas-tight sealing of the boiler against the outside is assured.

The total mass flow passes through the tubes 5, 8 and 11 and runs into headers 18 that are located above the boiler section 1 and the horizontal section 14. The headers 18 are connected to the horizontal header 16 through two downcomers 19 which extend downwardly outside of and near the horizontal section 14. Tubes 20 extend from the horizontal header 16 and form the combustion chamber nose 10 with the nose incline 13. In the illustrated embodiment, the tubes 20 extend through an additional intermediate header 21, however, such a header 21 is not absolutely necessary. The tubes 20 are then suitably bent, in accordance with the construction of the combustion chamber nose 10, and extend upwardly, at a transition from the horizontal section 14 to the boiler section 2 at the end of the nose incline 13, to an outlet or discharge header 22. The tubes 20 are gas-tightly weldedto one another to form the combustion chamber nose 10 and to form the nose incline 13, and fan out as they pass through the horizontal stage 14 so that also, at that location, the possibility of gas passage therebetween is afforded. Contact heating surfaces 23 are provided in the boiler section 2, and contact heating surfaces 24 in the boiler section 1 as well as in the horizontal section 14, the heating surfaces 23 and 24 respectively, having inlet and outlet headers. The connection of the last-mentioned headers mutually to feed an return lines of a non-illustrated turbine as well as to the outlet or discharge header 22 does not form any part of the invention of the instant application and is, therefore, not illustrated.

There are claimed:

1. In a continuous-flow boiler having a two-section contruction with gas-tightly welded walls and having a structure forming a combustion-chamber nose disposed beneath a horizontal section connecting both sections of the two-section boiler and including combustion chamber walls formed of a helical winding made up of wound parallel tubes which terminate in transition headers located externally to the combustion chamber walls at a point of transition of the tubes into vertical-tube walls extending upwardly from the helical winding, the combustion-chamber nose having a forward edge and an upper nose incline extending for a given distance along the top of the helical winding toward a front wall of the combustion chamber walls, two of the transition headers being disposed respectively adjacent lateral walls of the combustion chamber and extending from the front wall and terminating at the forward edge of the combustion-chamber nose, the tubes of the helical winding, in the region of the nose, being bent upwardly unwelded, auxiliary headers being disposed in step-wise offset relationship to one another below the nose incline, and the upwardly bent tubes of the helical winding being connected to said auxiliary headers, the lateral walls of the combustion chamber above the nose incline being formed of tubes extending upwardly from said auxiliary headers.

2. Structure according to claim 1 wherein the combustion chamber has a rear wall and one of the transition headers is disposed adjacent to the rear wall, and including mutually spaced-apart outlet tubes extending from said transition header adjacent the rear wall and through the horizontal section and serving as support elements for the rear wall, at least one further header disposed externally to and above the combustion chamber and being connected to said outlet tubes, and horizontally disposed connecting tubes connecting the transition header adjacent the rear wall to one of the transition headers that is located adjacent the front wall and to the transition headers adjacent the lateral walls of the combustion chamber.

3. Structure according to claim 2 including a horizontal header and intermediate section headers located between the two sections of the boiler, said intermediate section headers being located outside the combustion chamber and having tubes extending therefrom forming at least part of the lateral walls of the horizontal section, downcomers connecting said at least one further header above the combustion chamber to said horizontal header, and outlet tubes extending from said horizontal header and forming in part the tubes of the combustion chamber nose and in part extending and connected to said intermediate section headers.

* * * * *